US005814794A

United States Patent [19]

Lim

[11] Patent Number: 5,814,794

[45] Date of Patent: Sep. 29, 1998

[54] TEMPERATURE CONTROL APPARATUS OF MICROWAVE OVEN AND METHOD THEREOF

[75] Inventor: Gyu-Sik Lim, Suwon, Rep. of Korea

[73] Assignee: Samsung Electronics Co., Ltd., Suwon, Rep. of Korea

[21] Appl. No.: 613,768

[22] Filed: Feb. 28, 1996

[30] Foreign Application Priority Data

Feb. 28, 1995 [KR] Rep. of Korea ..... 1995/4212

[51] Int. Cl.[6] ..... H05B 6/68

[52] U.S. Cl. ..... 219/685; 219/681; 219/710; 219/757; 126/21 A

[58] Field of Search ..... 219/710, 757, 219/718, 681, 685, 720, 716; 126/21 A

[56] References Cited

U.S. PATENT DOCUMENTS

| | | | |
|---|---|---|---|
| 3,875,361 | 4/1975 | Fukui et al. | 219/757 |
| 4,227,062 | 10/1980 | Payne et al. | 219/718 |
| 4,309,584 | 1/1982 | Terakami | 219/720 |
| 4,459,449 | 7/1984 | Hirata | 219/720 |
| 4,831,225 | 5/1989 | Ishifuro et al. | 219/757 |
| 4,886,046 | 12/1989 | Welch | 219/757 |
| 5,128,158 | 7/1992 | Chartrain et al. | 423/233 |
| 5,350,903 | 9/1994 | Takei | 219/757 |

FOREIGN PATENT DOCUMENTS

| | | | |
|---|---|---|---|
| 1 196 968 | 11/1985 | Canada | 219/757 |
| 0 169 000 | 1/1986 | European Pat. Off. . | |
| 0 187 543 | 7/1986 | European Pat. Off. . | |
| 0 239 290 A2 | 9/1987 | European Pat. Off. . | |
| 0 281 263 A2 | 9/1988 | European Pat. Off. . | |
| 0 281 263 A3 | 9/1988 | European Pat. Off. . | |
| 0 239 290 A3 | 9/1997 | European Pat. Off. . | |
| 2206578 | 5/1988 | France . | |
| 60-135507 | 9/1985 | Japan . | |
| 2 241 615 | 9/1991 | United Kingdom . | |

*Primary Examiner*—Philip H. Leung
*Attorney, Agent, or Firm*—Burns, Doane, Swecker & Mathis, L.L.P.

[57] ABSTRACT

A microwave oven cooks in a microwave cooking mode using a magnetron, or in an oven cooking mode using a convection heater. A passage is provided for conducting outside air to the cooking chamber, and a fan is disposed in the passage for inducing the outside air flow. During the oven cooking mode, the convection heater is activated and the fan is deactivated, while the temperature in the cooking chamber is less than a reference temperature set by a user. When the temperature in the cooking chamber exceeds the reference temperature, the heater is deactivated, and the fan is activated.

4 Claims, 6 Drawing Sheets

FIG. 5A
TEMP. RELATIONSHIP
FIG. 5B
HEATER OPERATION
FIG. 5C
FAN OPERATION
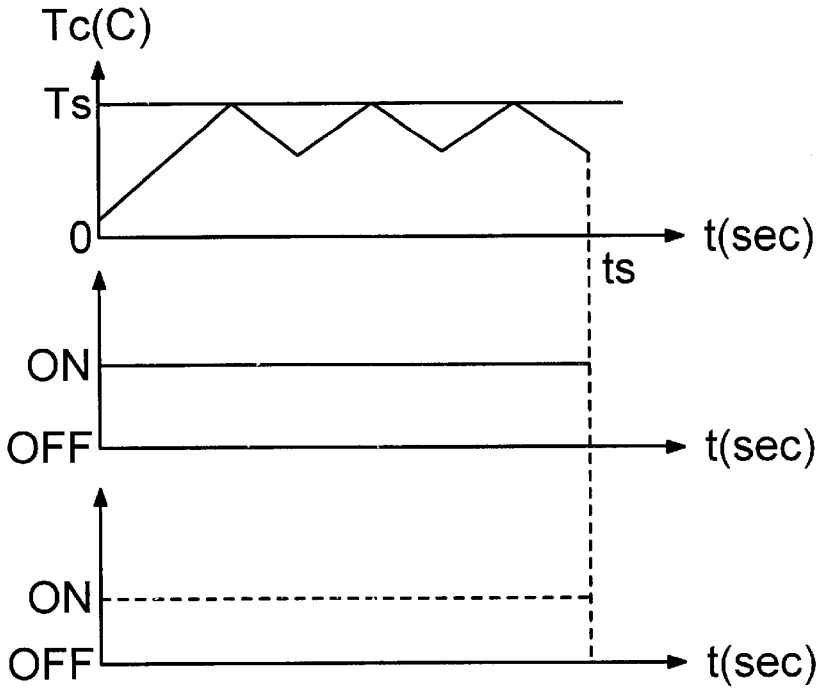
FIG. 6A
TEMP. RELATIONSHIP
FIG. 6B
HEATER OPERATION
FIG. 6C
FAN OPERATION
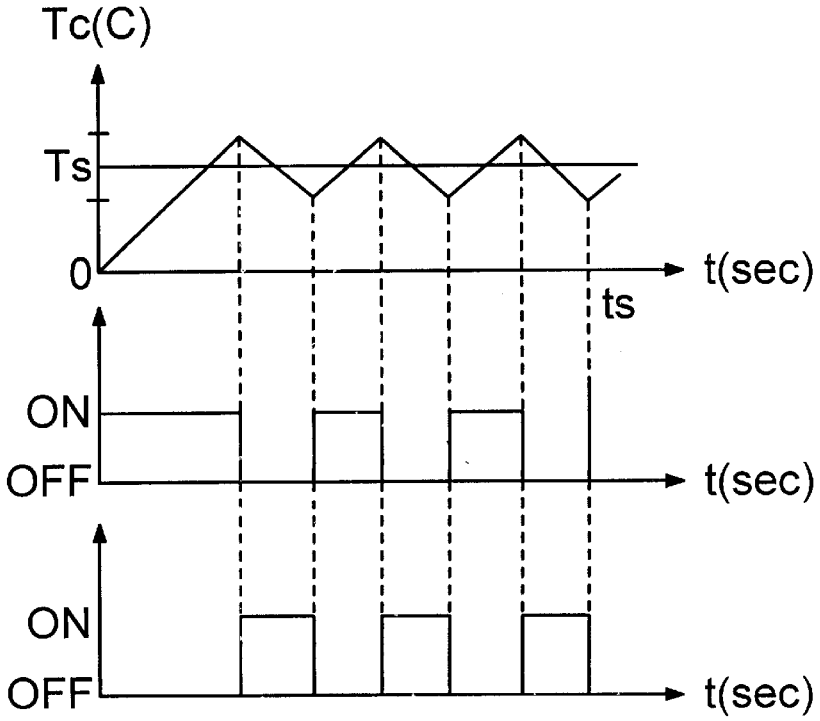

TEMPERATURE CONTROL APPARATUS OF MICROWAVE OVEN AND METHOD THEREOF

BACKGROUND OF THE INVENTION

1. Field of the Invention

The present invention relates to a microwave oven for cooking by using microwaves or heat generated from a convection heater, and more particularly to a temperature control method and apparatus of microwave oven by which temperature in a cooking chamber can be maintained at a predetermined level.

2. Description of the Prior Art

A conventional microwave oven is disclosed in Japanese laid open utility model Publication No. Sho 60-135507. The microwave oven disclosed in the Japanese laid open utility model is, as illustrated in FIGS. 1 and 2, constituted by a heating chamber 3 (hereinafter referred to as cooking chamber) formed in a body 1 for receiving food F therein, a microwave source 5 (hereinafter referred to as a magnetron) for supplying microwaves into the cooking chamber 3 in order to heat the food F, a cooling fan 7 for cooling the magnetron 5, heaters 9 and 11 for heating the food F, a gas sensor 13 for detecting the gas generated from the food F during the heating to thereby output a signal, a hot wind supplying heater (not shown) and a hot wind fan 15 for being disposed at an outside of the cooking chamber 3 to supply hot wind into the cooking chamber 3, absorption inlets 17 and 19 for being opened and closed in order to infuse outside air into the cooking chamber 3 and a control unit (not shown) for opening the absorption inlets 17 and 19 for a predetermined period of time from the start of the cooking and for driving the cooling fan 7 and the hot wind fan 15 to thereby exchange the air in the cooking chamber 3 with the outside air, so that the magnetron 5 and the heaters 9 and 11 can be operated.

In the aforementioned microwave oven thus constructed, when a user places the food on a rotary dish 21 in the cooking chamber 3 and presses a menu key corresponding to a "microwave oven" cooking utilizing high frequency output, the control unit serves to continuously operate the fan 16 and to open a damper 23 according to a key signal selected therefrom, thereby infusing the outside air into the cooking chamber 3 through the absorption inlets 17 and 19, so that steam generated in the course of heating the food can be discharged outside through a discharge outlet 25.

Meanwhile, when the user presses a menu key corresponding to "oven cooking" utilizing the heat generated from the heater, the control unit serves to continuously operate the fan 15 and to close the damper 23 according to the Key signal selected therefrom, to thereby cut off the air infused into the cooking chamber 3, so that the temperature in the cooking chamber 3 can be raised in a shortest possible time to reduce the temperature variation of each part in the cooking chamber 3 and to make it possible to cook the food.

However, in the conventional damper driving method thus described, there is a problem in that a damper must be installed to drive the cooling fan 7 for protecting each part from high temperature and high heat of other electrical parts during the microwave oven cooking or grill cooking and at the same time another separate damper should be equipped in order to close and open the absorption inlets 17 and 19 which are the passages of the air infused into the cooking chamber 3, thereby increasing the manufacturing cost and decreasing reliability due to the high rejection rate of the damper 23 itself during quality control inspection.

Furthermore, there is another problem in that the damper can become subject to air leakage in a closed condition after a long period of use to thereby lengthen the cooking time and decrease reliability to the user against the product as well because the cooking can be done in an irregular state.

Accordingly, the present invention has been disclosed to solve the aforementioned problems and it is an object of the present invention to provide a temperature control apparatus of a microwave oven and method thereof by which the air infused into the cooking chamber can be controlled by activating or deactivating a fan motor, to thereby reduce the manufacturing cost by the omission of a damper control mechanism.

It is another object of the present invention to provide a temperature control apparatus of microwave oven and method thereof by which a fan motor relay can be controlled according to the changing temperature in the cooking chamber to maintain an inner temperature of the cooking chamber at a constant level, so that the food can be evenly heated and the cooking time can be shortened

SUMMARY OF THE INVENTION

In accordance with one aspect of the present invention, there is provided a temperature control apparatus of a microwave oven, the temperature control apparatus comprising:

- cooking input means for inputting the cooking time, cooking menu and cooking temperature;
- control means for controlling overall operations according to a key signal input by the cooking input means;
- heater driving means for driving a heater in order to heat the food according to control of the control means;
- temperature detecting means for detecting the temperature in the cooking chamber that changes when the heater is driven by the heater driving means;
- fan motor driving means for receiving a control signal from the control means according to the temperature in the cooking chamber detected by the temperature detecting means to thereby control the air infused into the cooking chamber, so that a fan motor can be operated; and
- display means for displaying the cooking time, cooking menu and the cooking temperature input by the cooking input means according to the control of the control means.

In accordance with another aspect of the present invention, there is provided a temperature control method of a microwave oven, the method comprising the steps of:

- detecting the temperature in the cooking chamber that changes according to drives of the heater and the fan motor;
- comparing the temperature in the cooking chamber detected by the temperature detecting step with the cooking temperature established by a user;
- driving the fan heater and stopping the heater in order to lower the temperature in the cooking chamber when the temperature in the cooking chamber is above the established cooking temperature discriminated at the temperature comparing step; and
- driving the heater and stopping the fan motor in order to increase the temperature in the cooking chamber when the temperature in the cooking chamber is below the established cooking temperature.

BRIEF DESCRIPTION OF THE DRAWINGS

For a more complete understanding of the nature and objects of the invention, reference should be made to the following detailed description taken in conjunction with the accompanying drawings in which:

FIG. 5A is a waveform diagram when a temperature in a cooking chamber is below an established temperature;

FIG. 5B is an operational diagram of a heat relay when the temperature in the cooking chamber is below the established temperature;

FIG. 5C is an operational diagram of a fan motor relay when the temperature in the cooking chamber is below the established temperature;

FIG. 6A is a waveform diagram when the temperature in the cooking chamber is above the established temperature;

FIG. 6B is an operational constitutional diagram of a heater relay when the temperature in the cooking chamber is above the established temperature; and FIG. 6C is an operational constitutional diagram of a fan motor relay when the temperature in the cooking chamber is above the established temperature.

DETAILED DESCRIPTION OF A PREFERRED EMBODIMENT OF THE INVENTION

The embodiment of the present invention will now be described in detail with reference to the accompanying drawings.

Figure 1:
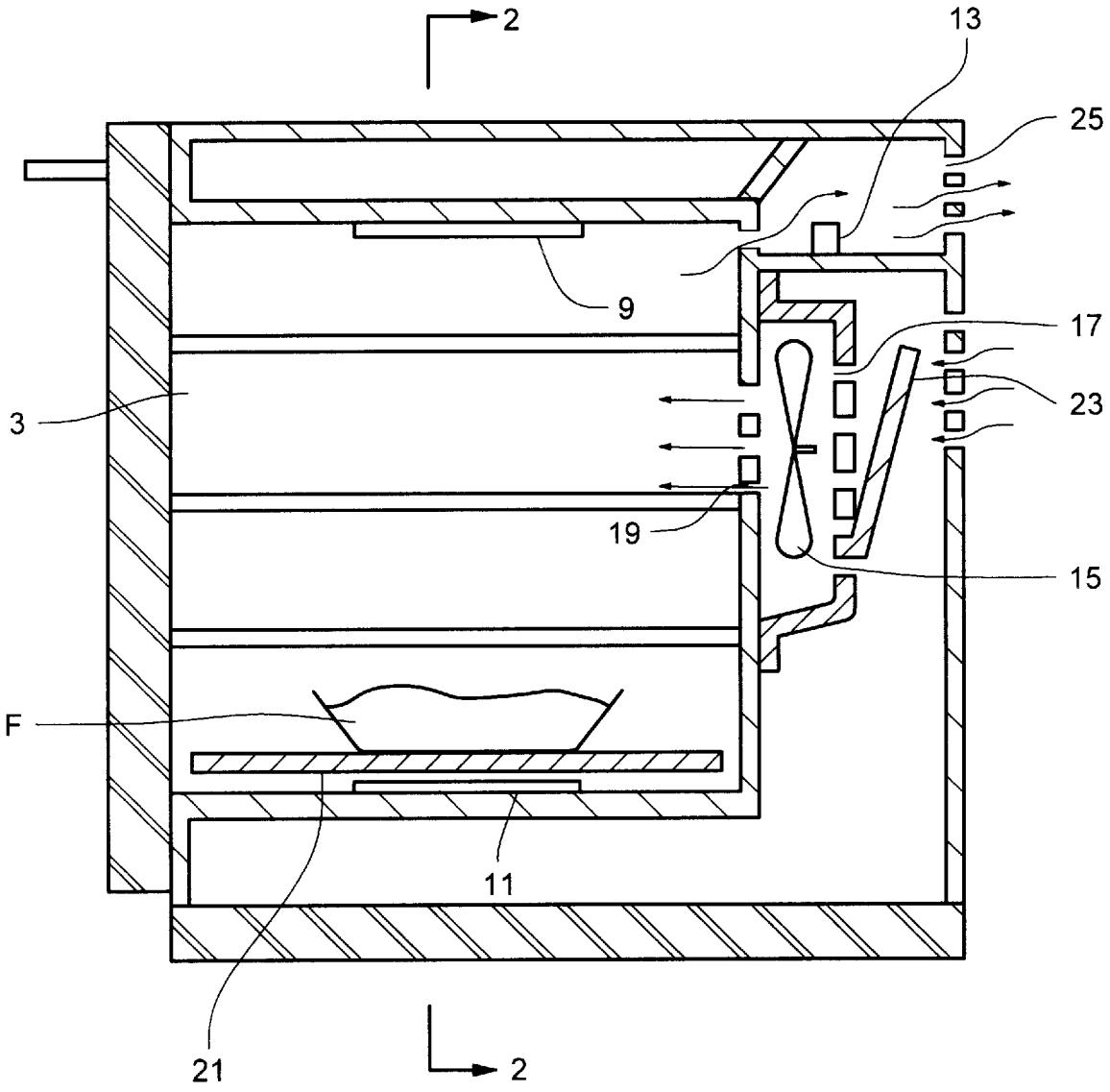
FIG. 1 (PRIOR ART)
FIG. 1 is a longitudinal sectional view of a microwave oven according to the prior art.
Figure 2:
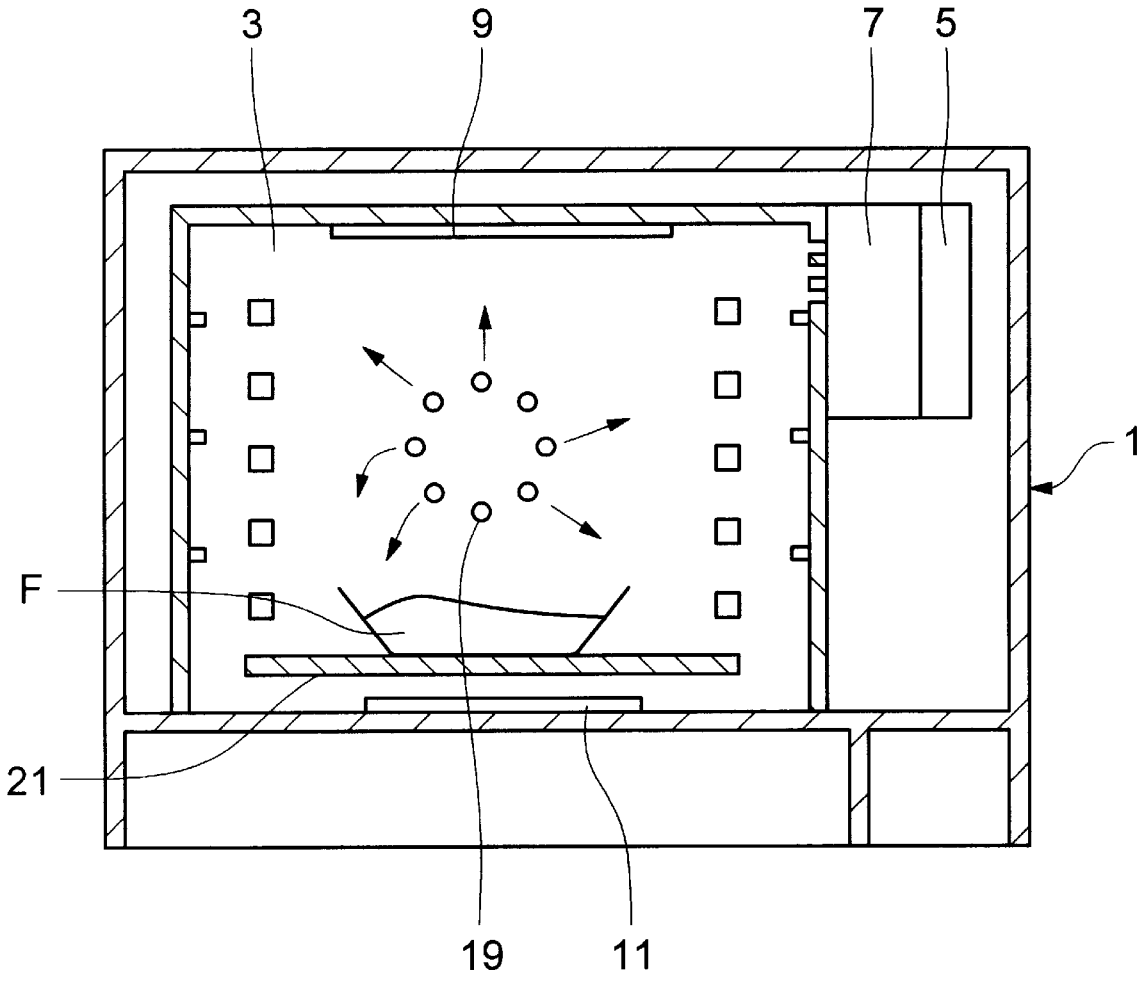
FIG. 2 (PRIOR ART)
FIG. 2 is a sectional view taken along line 2—2 in FIG. 1.
Figure 3:
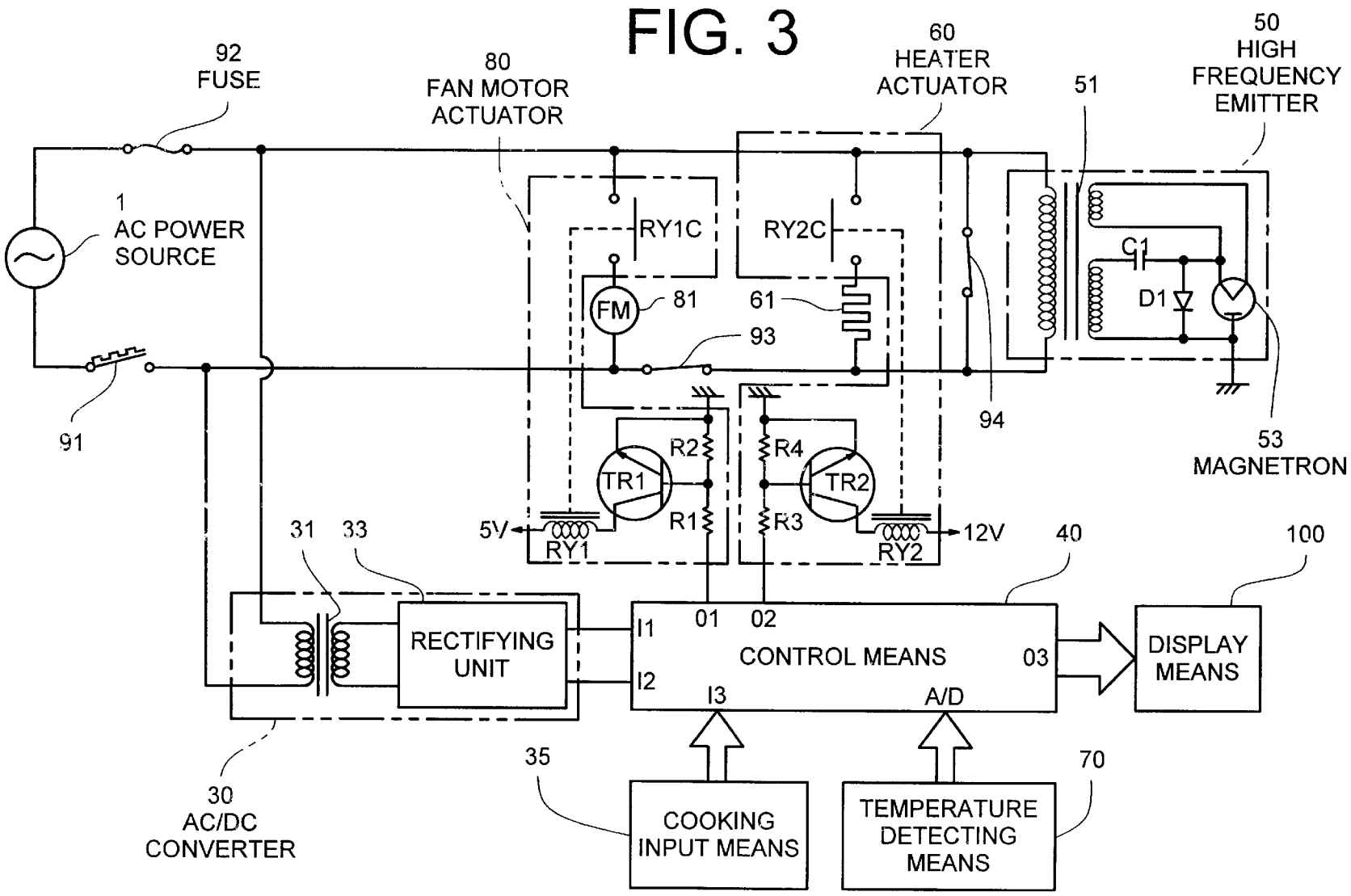
FIG. 3 is a detailed circuit diagram of a temperature control apparatus of a microwave oven according to one embodiment of the present invention.

As illustrated in FIG. 3, power supply means 30 serves to receive a commercial alternating current AC voltage supplied from an AC power source terminal 1 to convert the same to a predetermined direct current DC voltage necessary for driving the microwave oven and to output the same, where the power supply means 30 includes a step-down transformer 31 for receiving at the primary winding an AC voltage supplied from the AC power source terminal 1 to step down the same to a predetermined low level and to induce the same to the secondary winding, and a rectifying unit 33 for converting the AC voltage stepped down by the step-down transformer 31 to a predetermined DC voltage and for outputting the same.

Furthermore, cooking input means 35 is equipped with a plurality of function keys in order to input various cooking functions wanted by the user (cooking time establishment, cooking menu selection, cooking temperature establishment, microwave output control of the microwave oven, etc), and is also provided with a start button for starting a cooking operation of the microwave oven.

Control means 40 is a microcomputer adapted to receive the DC voltage output from the power source means 30 to initialize the microwave oven and at the same time to control overall cooking operations of the microwave oven according to a Key signal input by the cooking input means 35.

High frequency wave output means 50 serves to receive an AC voltage supplied from the AC power source terminal 1 to thereby output high frequency waves (microwaves), so that the food in the cooking chamber can be heated, where the high frequency wave output means 50 includes a step-up transformer 51 adapted to receive at the primary winding the AC voltage supplied from the AC power source terminal 1 to convert the same to a high level and to induce the same to the secondary winding, a magnetron 53 adapted to receive the high voltage converted by the step-up transformer 51 to thereby generate the high frequency waves, a high level capacitor C1 adapted to charge the voltage induced at the secondary winding of the step-up transformer 51 and a high level diode D1 adapted to rectify the voltage charged on the high level capacitor C1 to a multiplied voltage of high voltage and low current.

Heater driving means 60 serves to receive a control signal output from the control signal output from the control means 40 to thereby drive a heater during an "oven cooking" mode 61, so that the food in the cooking chamber can be heated, where the heater driving means 60 includes divider resistors R3 and R4 for dividing a heater driving signal output from an output terminal 02 of the control means 40, a transistor TR2 adapted to turn on or turn off by receiving at a base terminal thereof a voltage signal divided by the divider resistors R3 and R4, and a heater relay RY2 adapted to receive a voltage (12V) from external to thereby turn on or turn off so that the heater 61 can be driven or stopped when the transistor TR2 turns on or turns off.

Temperature detecting means 70 is a thermistor adapted to detect a temperature TC in the cooking chamber that changes according to drive of the heater 61, thereby supplying a temperature data of the cooking chamber to an input terminal (A/D) of the control means 40.

Fan motor driving means 80 serves to receive the control signal output from the control means 40 according to the temperature TC in the cooking chamber detected by the temperature detecting means 70 to drive a fan motor 81 (for driving a fan corresponding to fan 15 of Fig.) so that the air infused into the cooking chamber can be controlled, where the fan motor driving means 80 includes divider resistors R1 and R2 for dividing a motor driving signal output from an output terminal 01 of the control means 40, a transistor TR1 for receiving at a base terminal thereof a voltage signal divided by the divider resistors R1 and R2 to thereby turn on or turn off, and a fan motor relay RY1 for receiving a voltage (5V) to thereby turn on or turn off in order to drive or stop the fan motor 81 when the transistor TR1 turns on or turns off.

Protecting means serves to safely protect a circuit when high frequency waves are output from the high frequency wave output means 50, where the protecting means includes a temperature switch 91, a fuse 92, a safety switch 93, and a monitor switch 94. The temperature switch 91 is disposed at one side of the AC power source terminal 1 in order to inhibit an AC voltage supplied to the step-up transformer 51 and the step-down transformer 31 from the AC power source terminal 1 when the temperature in the cooking chamber is excessively raised up. The fuse 92 is disposed at the other end of the AC power source terminal 1 in order to inhibit the AC voltage supplied from the AC power source terminal 1 to the step-up transformer 51 and the step-down transformer 31 when an excessive current flows in the circuit. The safety switch 93 is adapted to be switched on or switched off in order to prevent leakage of high frequency waves when a door of the microwave oven is opened or closed. The monitor switch 94 is adapted to be connected to a primary winding of the step-up transformer 51 in order to check whether or not the safety switch 93 is working.

Display means 100 serves to display under the control of the control means 40 the cooking time, cooking menu, cooking temperature Ts and the like input by the user at the cooking input means 35.

Now, the operation of the temperature control apparatus of a microwave oven thus constructed will be described.

Figure 4A:
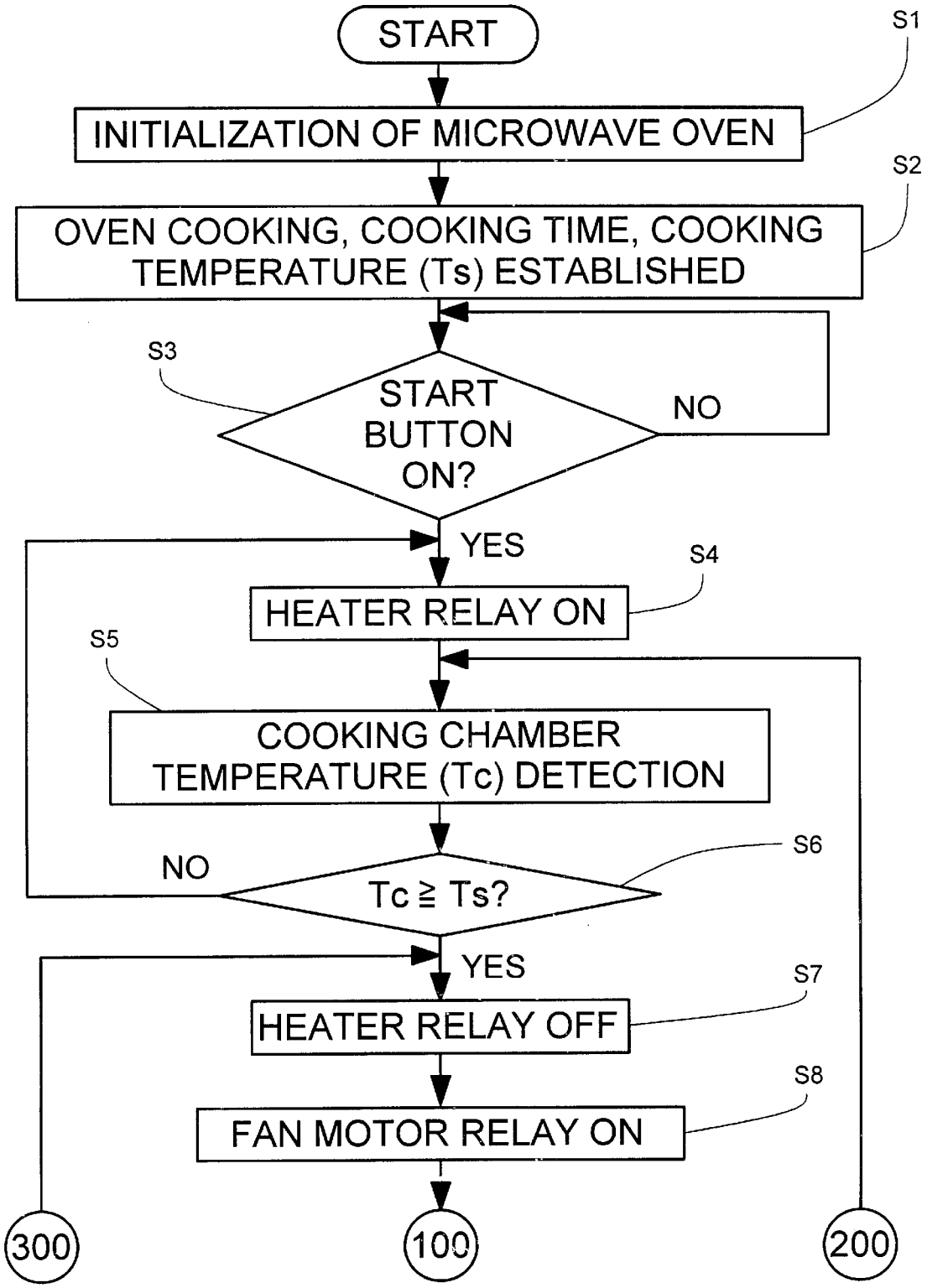
FIG. 4A and 4B are flow charts for illustrating temperature control operational procedures according to the present invention.
Figure 4B:
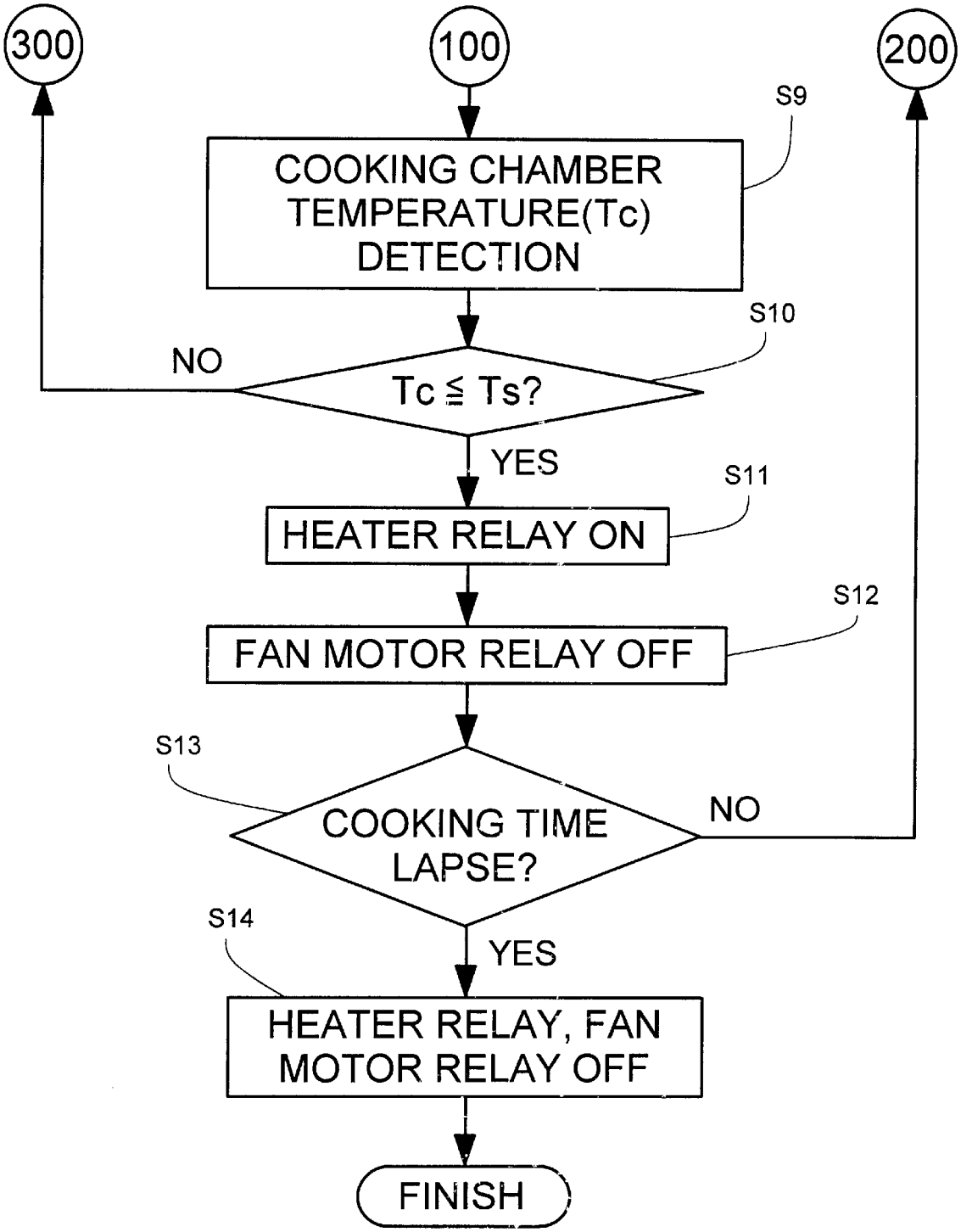

FIGS. 4A and 4B are flow charts for illustrating operational procedures of a temperature control of a microwave oven according to the present invention, where reference symbol "S" denotes a step.

First of all, when a power is supplied to the microwave oven, the AC voltage supplied from the AC power source terminal 1 is induced to the primary winding of the step-down transformer 31 at the power source 30.

At this time, the AC voltage of the AC power source terminal 1 applied to the primary winding is stepped down by the step-down transformer 31 to a predetermined level suitable for operation of the circuit to thereafter be output to the rectifying unit 33 at the secondary winding, where the AC voltage stepped down by the step-down transformer 31 is converted to a predetermined DC voltage necessary for driving of the microwave oven, so that voltage for driving the control means 40 and a relay is generated.

Accordingly, at step S1, a driving voltage of 5V output from the rectifying unit 33 is received by the control means 40 to thereby initialize the microwave oven.

At step S2, when the user puts the food in the cooking chamber, and establishes an "oven cooking" menu including cooking time and cooking temperature Ts, an operational command signal is input to an input terminal 13 of the control means 40 from the cooking input means 35.

Successively, at step S3, a discrimination is made as to whether a start button of the cooking input means 35 has been pressed, and if it is discriminated that the start button is not pressed (in case of no), flow returns to step S3, and maintains the microwave oven in an operation wait state until the start button is pressed.

If the start button is pressed (in case of yes), an operation start signal is input from the cooking input means 35 to the input terminal of the control means 40, which in turn advances to step S4 and outputs to the heater driving means 60 a heater driving signal of high level through the output terminal 02 to control a heating operation of the heater 61.

As a result, the heat driving signal of high level output from the output terminal 02 at the control means 40 is divided through the divider resistors R3 and R4 to thereafter be applied to a base terminal of the transistor TR2, which in turn is activated.

When the transistor TR2 is activated, a current is induced to the heater relay RY2 because the current flows to ground through the heater relay RY2 and via the transistor TR2 by way of a voltage (12V) from external, and thereafter, a contact RY2C of the heater relay RY2 is turned on.

When the contact RY2C of the heater relay RY2 is turned on, the AC voltage supplied from the AC power source terminal 1 is applied to the heater 61 through the contact RY2C of the heater relay RY2, thereby causing the heater 61 to start emitting heat.

When the heater 61 starts emitting heat, the heat generated by the heater 61 is applied to the food in the cooking chamber to thereby heat the food during the "oven cooking" mode.

At step S5, the temperature in the cooking chamber TC that changes while the heater 61 generates the heat is detected by the temperature detecting means 70 and is output to the control means 40 through an input terminal A/D.

At step S6, the control means 40 serves to convert to a digital value an analog value of the temperature in the cooking chamber TC detected by the temperature detecting means 70, to thereby discriminate whether the temperature in the cooking chamber TC is above a cooking temperature (TS hereinafter referred to as established or set cooking temperature) established by the user by way of cooking input means 35.

As a result of the discrimination at step S6, as illustrated in FIG. 5A, if the temperature in the cooking chamber TC is not above the established cooking temperature TS (in case of no), which is a state where the temperature in the cooking chamber TC has not reached the established cooking temperature TS, flow returns to step S4, and as illustrated in FIG. 5B, to keep driving the heater 61.

The fan motor relay RY1 is off as illustrated in FIG. 5C, so the fan motor 81 is off.

Meanwhile, as a result of the discrimination at step S6, as illustrated in FIG. 6A, if the temperature in the cooking chamber TC is above the established cooking temperature TS (in case of yes), which is a state where the temperature in the cooking chamber TC has reached the established cooking temperature TS, flow advances to step S7, where the control means 40 serves to output to the heater driving means 60 a heater driving signal of lower level through the output terminal 02 in order to stop the driving of the heater 61.

Accordingly, the heater driving signal of low level output from the output terminal 02 of the control means 40 is applied to a base terminal of the transistor TR2 through the divider resistors R3 and R4, thereby rendering the transistor TR2 inoperative.

When the transistor TR2 is rendered inoperative, the contact RY2C of the heater relay RY2 is turned off because there flows no current in the heater relay RY2. When the contact RY2C of the heater relay RY2 is rendered inoperative, the AC voltage applied to the heater 61 from the AC power source terminal 1 is cut off, to thereby cause the heater 61 not to emit heat.

Successively, at step S8, the control means 50 serves to output to the fan motor driving means 80 a motor driving signal of high level through the output terminal 01 in order to reduce the temperature TC in the cooking chamber when the heater 61 is stopped.

Accordingly, the motor driving signal of high level output from the output terminal 01 of the control means 40 is divided through the divider resistors R1 and R2 to thereafter be applied to a base terminal of the transistor TR1, which in turn is rendered operative.

When the transistor TR1 is rendered active, a current is induced to the fan motor relay RY1, which in turn activates the contact RY1C thereof because the current is caused to flow to ground through the fan motor relay RY1 and via the transistor TR1 by way of the voltage (5V).

When the contact RY1C of the fan motor relay RY1 is rendered activated, AC voltage supplied from the AC power source terminal 1 is applied to the fan motor 81 through the contact RY1C of the fan motor relay RY1, so that the fan motor 81 starts to be driven.

When the fan motor 81 is driven, a cooling fan is rotated and cool outside air is infused into the cooking chamber through a suction inlet of the microwave oven, thereby lowering the temperature in the cooking chamber TC.

In other words, as illustrated in FIGS. 6B and 6C, when the heater relay RY2 is rendered inoperative, and when a predetermined period of time lapses while the fan motor relay RY1C is operative, the temperature in the cooking chamber TC grows lower, so that, at step S9, the changing temperature in the cooking chamber TC is detected by the temperature detecting means 70 and is output to the input terminal A/D of the control means 40.

Accordingly, at step S10, the control means 40 discriminates whether the temperature in the cooking chamber TC detected by the temperature detecting means 70 is below the established cooking temperature TS established by the user according to the cooking input means 35, and if the temperature in the cooking chamber TC is not below the established cooking temperature TS (in case of no), which is, as illustrated in FIG. 6A, a state where the temperature in the cooking chamber TC has not been reduced to the cooking temperature TS established by the user, flow returns to step S7, where, as illustrated in FIG. 6B, the heater relay RY2 is rendered inactive to keep the heater 61 off.

Also, as illustrated in FIG. 6C, the fan motor relay RY1 is still activated to thereby drive the fan motor 81 continuously, and operations subsequent to step S7 are repeatedly performed.

As a result of the discrimination at step S10, if the temperature in the cooking chamber TC is below the established cooking temperature TS (in case of yes), the control means 40, at step S11, serves to output a heater driving signal of high level to the heater driving means 60 through the output terminal 02 in order to drive the heater 61.

As a result, the heater driving signal of high level output from the output terminal 02 at the control means 40 is divided through the divided resistors R3 and R4 to thereby be applied to a base terminal of the transistor TR2 and to therefore activate the transistor TR2.

When the transistor TR2 is rendered activated, the heater relay RY2 is induced with current to thereby activate the contact RY2C of the heater relay RY2 because the current flows to ground through the heater relay RY2 and via the transistor TR2 by way of the voltage (5V) applied from external.

When the contact RY2C of the heater relay RY2 is rendered operative, the AC voltage supplied from the AC power source terminal 1 is applied to the heater 61 through the contact RY2C of the heater relay RY2 to cause the heater 61 to emit heat again and to thereby heat the cooking chamber.

Successively, at step S12, the control means 40 serves to output to the fan motor driving means 80 a motor driving signal of low level through the output terminal 01 in order to stop the drive of the fan motor 81.

As a result, the motor driving signal of low level output from the output terminal 01 of the control means 40 is applied to the base terminal of the transistor TR1 through the divider resistors R1 and R2 to thereby deactivated the transistor TR1.

When the transistor TR1 is turned off, the current is not induced to the fan motor relay RY1, so that the contact RY1C of the fan motor relay RY1 is rendered deactivated.

When the contact RY1C of the fan motor relay RY1 is rendered inactive, the AC voltage applied from the AC power source terminal 1 to the fan motor 81 is cut off to thereby stop the fan motor 81.

In other words, as illustrated in FIGS. 6B and 6C, at step S13, a discrimination is made of whether the cooking time established by the user at the cooking input means 35 has elapsed while the heater relay RY2 is on and the fan motor relay RY2 is off, and if the cooking time has not lapsed (in case of no), flow returns to step S5, and operations subsequent to step S5 are repeatedly performed until the cooking time elapses.

As a result of the discrimination at step S13, if the cooking time has lapsed (in case of yes), flow advances to step S14, where the control means 40 serves to output a control signal of low level to the heater driving means 60 and to the fan motor driving means 80 in order to stop driving of the fan motor 81 and the heater 61.

As a result, the transistor TR2 at the heater driving means 60 is rendered inoperative by way of the heater driving signal of low level output from the output terminal 02 at the control means 40, thereby causing the current not to flow in the heater relay RY2 and rendering the contact RY2C of the heater relay RY2 to be inoperative.

When the contact RY2C of the heater relay RY2 is rendered off, the AC voltage applied from the AC power source terminal 1 to the heater 61 is cut off to thereby stop driving the heater 61.

In addition, the transistor TR1 at the fan motor driving means 80 is rendered inactivated by the motor driving signal of low level output from the output terminal 01 at the control means 40, so that the current is not caused to flow in the fan motor relay RY1 and the contact RY1C of the fan motor motor relay RY1 is in turn rendered inoperative.

When the contact RY1C of the fan motor relay RY1 is rendered inoperative, the AC voltage applied from the AC power source terminal 1 to the fan motor 81 is cut off, thereby stopping the drive of the fan motor 81 and completing the operations.

As apparent from the foregoing, there is an advantage in the temperature control apparatus of a microwave oven and a method thereof according to the present invention in that the air infused into a cooking chamber can be controlled by way of a fan motor to thereby reduce manufacturing cost due by omitting a damper and a damper control circuit, and a fan motor relay can be controlled according to the changing temperature in the cooking chamber to thereby maintain an inner temperature in the cooking chamber at a predetermined constant level, so that the food can be evenly heated and cooking time can be shortened.

Having described a specific preferred embodiment of the invention with reference to the accompanying drawings, it is to be understood that various changes and modifications may be effected therein by one skilled in the art without departing from the scope or spirit of the invention as defined in the appended claims.

What is claimed is:

1. A microwave oven capable of microwave and oven cooking operations, comprising:

a cooking chamber;

a magnetron for performing microwave cooking in the cooking chamber;

an electrical heater for performing oven cooking in the cooking chamber;

a passage for conducting outside air into the cooking chamber;

a motor-driven fan in the passage for inducing a flow of outside air into the cooking chamber;

a temperature detector for detecting a temperature in the cooking chamber;

a user input mechanism enabling a user to select between microwave and oven cooking operations and for setting a cooking temperature in an oven cooking operation; and a control mechanism connected to the fan and the temperature detector for deactivating the fan and activating the electrical heater while the detected temperature is below the cooking temperature during an oven cooking operation, and for actuating the fan and deactivating the electrical heater while the detected temperature is above the cooking temperature during an oven cooking operation.

2. The microwave oven according to claim 1 further including a heater operating circuit in which the heater is disposed, the heater operating circuit including two divider resistors for dividing a heater operating signal received from the control mechanism; a transistor connected to the divider resistors to be activated or deactivated in response to a magnitude of a voltage signal received from the divider resistors; and a heater relay connected to the heater and the transistor for activating the heater when the transistor is activated.

3. The microwave oven according to claim 1 further including a fan operating circuit in which the fan is disposed, the fan operating circuit including two divider resistors for dividing a fan operating signal received from the control mechanism; a transistor connected to the divider resistors to be activated or deactivated in response to the magnitude of a voltage signal received from the divider resistors; and a fan motor connected to the fan and the transistor for activating the fan when the transistor is activated.

4. In a method of operating a microwave oven having a microwave cooking mode wherein cooking is performed in a cooking chamber by a magnetron, and an oven cooking mode wherein cooking is performed in the cooking chamber by an electrical heater, the microwave oven including a passage for conducting outside air into the cooking chamber, and a motor-driven fan in the passage for inducing a flow of outside air into the cooking chamber, a method of performing a cooking operation in the oven cooking mode comprising the steps of:

A) setting a desired cooking temperature;

B) actuating the electrical heater for establishing the cooking temperature in the cooking chamber;

C) detecting a temperature in the cooking chamber;

D) activating the heater and deactivating the fan while the detected temperature is below the cooking temperature during the cooking operation; and E) activating the fan and deactivating the heater while the detected temperature is above the cooking temperature during the cooking operation.

* * * * *